US007036905B2

(12) United States Patent
Nagai et al.

(10) Patent No.: US 7,036,905 B2
(45) Date of Patent: May 2, 2006

(54) INKJET RECORDING APPARATUS

(75) Inventors: Masaru Nagai, Iruma (JP); Takashi Tsutsumi, Hachioji (JP); Keiichiro Suzuki, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 0 days.

(21) Appl. No.: 11/038,666

(22) Filed: Jan. 19, 2005

(65) Prior Publication Data

US 2005/0168515 A1 Aug. 4, 2005

(30) Foreign Application Priority Data

Jan. 29, 2004 (JP) ..... 2004-021627

(51) Int. Cl.
*B41J 2/165* (2006.01)
*B41J 2/01* (2006.01)

(52) U.S. Cl. ..... 347/22; 347/33; 347/104

(58) Field of Classification Search ..... 347/22, 347/32, 104, 33; 198/495–499; 400/635; 271/7, 275; 15/256.5, 256.51, 256.52; 399/312, 399/344, 347; 101/425
See application file for complete search history.

(56) References Cited

U.S. PATENT DOCUMENTS 6,916,081 B1 * 7/2005 Nakashima ..... 347/32
2003/0039495 A1 2/2003 Takami et al.

FOREIGN PATENT DOCUMENTS

| | | | |
|---|---|---|---|
| JP | 03-111356 | A | 5/1991 |
| JP | 03-227648 | | 10/1991 |
| JP | 04-219264 | | 8/1992 |
| JP | 05-092632 | | 4/1993 |
| JP | 11-192694 | A | 7/1999 |
| JP | 2000-272107 | A | 10/2000 |
| JP | 2002-046885 | A | 2/2002 |
| JP | 2003-205658 | A | 7/2003 |

* cited by examiner

*Primary Examiner*—Shih-wen Hsieh
(74) *Attorney, Agent, or Firm*—Frishauf, Holtz, Goodman & Chick, P.C.

(57) ABSTRACT

There is provided an inkjet recording apparatus having a cleaning device, which can securely remove ink on a conveying belt having no negative effects on conveyance accuracy. The inkjet recording apparatus for forming an image on a recording medium includes a conveying belt for supporting and conveying a recording medium, a recording head for forming an image by jetting ink onto the recording medium conveyed by the conveying belts, and a cleaning device having a cleaning roller provided in pressure-contact with the conveying belt and driven to rotate in the same direction as the conveying direction of the conveying belt, wherein, the cleaning roller is set to rotate at a surface linear speed thereof lower than a conveying speed of the conveying belt.

7 Claims, 6 Drawing Sheets

INKJET RECORDING APPARATUS

FIELD OF THE INVENTION

The present invention relates to an inkjet recording apparatus, and particularly relates to an inkjet recording apparatus provided with a cleaning device capable of securely removing ink from a conveying belt without causing negative effects on the conveying accuracy.

BACKGROUND OF THE INVENTION

In recent years, as an apparatus for performing image formation with high resolution on various types of recording media, inkjet type image recording apparatuses are widely used. Particularly, in some cases where the recording medium is of a flexible material such as cloth, the recording medium is conveyed under a recording head by an endless conveying belt. In this situation, errors in feeding of the recording medium, so-called edgeless printing, oozing ink out of the back, or the like may cause ink jetted from a recording head to adhere to the conveying belt. Accordingly, ink deposited on the conveying belt is transferred to a newly fed recording medium on the conveying belt to cause a problem such as staining of the subsequently led recording medium. Therefore, such an inkjet recording apparatus having a conveying belt is usually provided with a cleaning device for cleaning the conveying belt.

As means for cleaning a conveying belt, there are known recording apparatuses and conveying devices provided with a cleaning device that wipes off unnecessary ink deposited on the conveying belt with a blade wiper and absorbs ink with a liquid absorption material as auxiliary means (for examples, see Patent Documents 1 to 3). However, in these apparatuses, the blade wiper and the liquid absorption material are pressed hard against the conveying belt, which may damage the conveying belt and affect its durability. Further, in the case where ink deposited on the conveying belt dries and becomes fixed on the conveying belt, the ink cannot always be removed enough. Still further, if the belt width is one meter or longer as in the case of a conveying belt used in an inkjet recording apparatus for textile printing on cloth, it is usually difficult to uniformly press the edge of a blade wiper against a conveying belt surface over the entire width of the conveying belt.

Further, another type of cleaning means is disclosed, that is, an image forming apparatus provided with a cleaning device that absorbs and wipes off ink deposited on a conveying belt with a roller or a pad having a high molecular water absorption polymer (for example, see Patent Document 4). In this apparatus, a double structured roller constructed of a high molecular water absorption polymer, which is an ink absorption layer, covered with a nonwoven material, is employed. Particularly, when a pigment ink is used, dye particles in the ink tend to stay in the nonwoven material or in the surface layer of the high molecular water absorption polymer, reducing the ink absorption function. For example, when so-called edgeless image recording is performed in textile printing on cloth, sometimes ink adheres to a part, around the edges of the cloth, of the surface of the conveying belt. In this case, dye particles in the ink tend to accumulate in a corresponding part of the roller, and the absorption capability of this part drops relatively soon. This causes a problem requiring extremely frequent replacement of the roller and other components.

On the other hand, for such an apparatus, in order to avoid negative effects on the conveying accuracy of the conveying belt (see Patent Document 4), the blade wiper, the roller, and the like, are detached from the conveying belt during image recording, assuming cleaning of the conveying belt during non-recording time, such as prior to resuming of recording operation after occurrence of paper jam (see Patent Documents 1 through 3) or when cleaning is necessary (see Patent Document 4). However, in such a case as the above stated textile printing on cloth, image recording is often performed on a long cloth continuously for a long time, and if the conveying belt is left uncleaned during the image recording, ink continues to adhere to the conveying belt and stains the cloth as a recording medium. In such a way, ink is fixed on the conveying belt. Therefore, it is necessary to clean the conveying belt simultaneously while performing image recording on the cloth.

As an inkjet recording apparatus that performs cleaning of a conveying belt simultaneously during image recording, as described above, there is known an inkjet recording apparatus having a conveying device which cleans the conveying belt by removing ink deposited on the conveying belt by sandwiching the conveying belt between a guide roller, such as a tension roller, and a rotatable cleaning sponge in a roller form (for example, see Patent Document 5). In this apparatus, a dewatering belt is arranged downstream in the conveyance direction of the conveying belt with respect to the cleaning sponge so that the dewatering belt contacts the conveying belt to dewater the conveying belt. Or, an air blower is likewise arranged downstream of the conveying belt with respect to the cleaning sponge so that air is blown onto the conveying belt, thereby drying the conveying belt.

[Patent Document 1] Japan Patent No. 2705992
[Patent Document 2] Japan Patent No. 2891796
[Patent Document 3] Japan Patent No. 3016924
[Patent Document 4] TOKKAI No. 2000-272107
[Patent Document 5] TOKKAI No. 2003-205658

However, in the inkjet recording apparatus disclosed in Patent Document 5, a number of needle-shaped protrusions is provided on a conveying belt to anchor a recording medium relative to the conveying belt so that the recording medium cannot slide on the conveying belt. Therefore, the conveyance speed of the conveying belt and the surface linear speed of the cleaning sponge are necessarily the same. The cleaning sponge, herein, only absorbs ink on the conveying belt in a state of contact with the conveying belt, and cannot have relative motion that enables wiping off ink. Consequently, there have been some cases where ink on the surface of a belt is not removed well. Further, if the conveying belt is dried by a drying device, such as an air blower, downstream with respect to the cleaning sponge in a state that ink is not adequately removed from the conveying belt, solid portions such as dye are left on the conveying belt, causing subsequent problems in image recording. Still further, this apparatus has the drawback of requiring a large amount of consumption power for drying the conveying belt.

In order to wipe ink off a conveying belt with a cleaning sponge, it is necessary to provide a difference between the conveyance speed of the conveying belt and the surface linear speed of the cleaning sponge. However, if a speed difference is provided, friction from the cleaning sponge causes a load on conveyance of the conveying belt, which may have negative affects on the accuracy of conveyance of the recording medium by the conveying belt, as pointed out in Patent Document 4. Particularly, in the case where cleaning of a conveying belt and image recording are simultaneously performed as stated above, when the accuracy of conveyance of the conveying belt drops, irregularities will be generated in image recording on the recording medium. Accordingly, it is required to develop an inkjet recording apparatus having a cleaning device that features a cleaning performance capable of securely removing ink on the conveying belt and can clean the conveying belt without causing negative effects on conveyance accuracy.

SUMMARY OF THE INVENTION

With this background, a primary object of the invention is to provide an inkjet recording apparatus having a cleaning device that can securely remove ink on the conveying belt without negative effects on conveyance accuracy. Further, another object of the invention is to provide an inkjet recording apparatus having a cleaning device which can be applied to a belt having a large width such as a conveying belt used in an inkjet recording apparatus for textile printing on cloth, wherein the cleaning device does not require a drying device and can maintain secure cleaning performance for a long time period.

In an aspect of the invention, an inkjet recording apparatus for forming an image on a recording medium includes a conveying belt for supporting and conveying a recording medium, a recording head for forming an image by jetting ink onto the recording medium conveyed by the conveying belt, and a cleaning device having a cleaning roller provided in pressure-contact with the conveying belt and driven to rotate in the same direction as a conveying direction of the conveying belt, wherein, the cleaning roller is set to rotate at a surface linear speed thereof lower than a conveying speed of the conveying belt.

According to the above aspect, ink deposited on a conveying belt is dissolved and diffused in a water squeezed out from a cleaning roller, then, ink and water on the conveying belt are wiped off by the cleaning roller, and further the water containing the dissolved and diffused ink is absorbed by the cleaning roller. Thus, the ink and water on the conveying belt can be securely removed. The cleaning roller, herein, effectively absorbs the water having dissolved and diffused ink from the conveying belt, and thus reduces the wetness of the conveying belt to an extremely low level after the portion of the conveying belt has passed the cleaning device. Thus, the conveying belt dries almost completely while the conveying belt circulates and before a new recording medium or a new portion of the same recording medium is fed onto the conveying belt. Accordingly, a conventional drying device or the like is not necessary and electric power consumption can be further reduced.

Further, the surface linear speed of the cleaning roller is set to be lower than the conveyance speed of the conveying belt. Thus, the friction between the cleaning roller and the conveying belt, caused by the non-synchronous rotation of the cleaning roller, works to increase the tension applied to the conveying belt at a part just under recording heads of an inkjet recording apparatus, increasing the tightness of the conveying belt with a, belt driving roller and a driven roller. Thus, compared with a case where the surface linear speed of the cleaning roller is set higher than the conveyance speed of the conveying belt and thereby tension applied to the conveying belt at a part just under the recording head of the inkjet recording apparatus is decreased to reduce the stability of rotation of the conveying belt, the conveying accuracy of the conveying belt is little degraded, and, practically, the negative effects of it can be reduced to an almost negligible extent.

PREFERRED EMBODIMENT OF THE INVENTION

Figure 1:
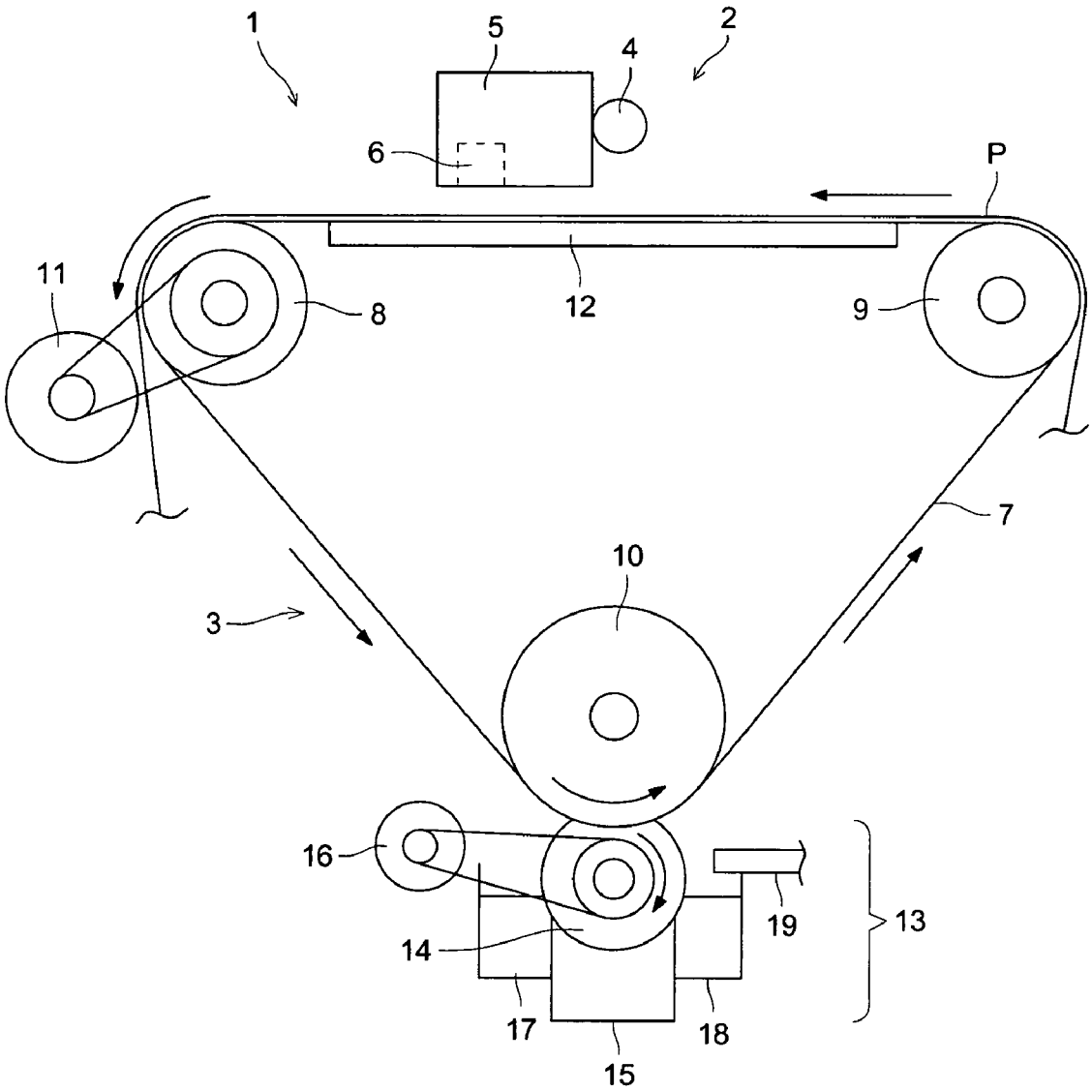
FIG. 1 is a schematic diagram of an inkjet recording apparatus of an embodiment in accordance with the invention.

The invention includes the following structures.

(1) An inkjet recording apparatus for forming an image while conveying a recording medium by a conveying belt has a cleaning device arranged to have pressure-contact with the conveying belt and provided with a cleaning roller that is driven to rotate in the same direction as the conveyance direction of the conveying belt, wherein the cleaning roller is set in such a manner that the cleaning roller rotates at a surface linear speed lower than the conveyance speed of the conveying belt.

According to the above item (1), ink deposited on a conveying belt is dissolved and diffused in a water squeezed out from a cleaning roller, then, ink and water on the conveying belt are wiped off by the cleaning roller, and further the water containing the dissolved and diffused ink is absorbed by the cleaning roller. Thus, the ink and water on the conveying belt can be securely removed. The cleaning roller, herein, effectively absorbs the water having dissolved and diffused ink from the conveying belt, and thus reduces the wetness of the conveying belt to an extremely low level after the portion of the conveying belt has passed the cleaning device. Thus, the conveying belt dries almost completely while the conveying belt circulates and before a new recording medium or a new portion of the same recording medium is fed onto the conveying belt. Accordingly, a conventional drying device or the like is not necessary and electric power consumption can be further reduced.

(2) In the inkjet recording apparatus described in above item (1), the pressing depth of the cleaning roller against the conveying belt is set such that the ink remaining rate on the conveying belt after cleaning is 5% or less, and set in a range where the cleaning roller does not rotate driven by the friction force between the cleaning roller and the conveying belt.

According to item (2), if the ink remaining rate on a conveying belt after cleaning is 5% or less, image recording can be performed without staining of a recording medium with ink remaining on the conveying belt. Further, a cleaning roller is pressed in the range where the cleaning roller does not rotate driven by the friction between the cleaning roller and the conveying belt. Thus, in addition to the above effects of the invention, the cleaning roller can exert effects to wipe off ink and water from the conveying belt, which allows it to further securely remove ink from the conveying belt.

(3) The cleaning roller of the inkjet recording apparatus of item (1) or (2) is a PVC open-cell foam roller.

According to item (3), a PVC open-cell foam is employed as a material of a cleaning roller to form a long roller. By pressure-contacting the long cleaning roller, parallelly to the tension roller, with a conveying belt supported from the inner surface side by a tension roller or the like, the cleaning roller can be pressure-contacted with the conveying belt uniformly over the entire width of the conveying belt. Thus, the effects of the invention described in the above respective items can be applied to a wide belt such as a conveying belt used in an inkjet recording apparatus for textile printing on cloth. Further, by forming the cleaning roller as a PVC open-cell foam roller, ink can be dissolved into water in a water bath without remaining on or in the cleaning roller. Thus, the cleaning roller can maintain a high ink absorption capability for a relatively long period, unlike conventional cases, and a secure excellent cleaning performance for a long period.

(4) In the inkjet recording apparatus of any one of items (1) through (3), the cleaning roller is set to be pressure-contacted with the conveying belt by a load that makes the pressing depth of the cleaning roller against the conveying belt in a range from 1 to 3 mm.

According to item (4), a cleaning roller is pressure-contacted with a conveying belt by a load making the pressing depth of the cleaning roller, constructed as a PVC open-cell foam roller, against the conveying belt in a range from 1 to 3 mm. Thus, the ink remaining rate on the conveying belt after cleaning can be cured to 5% or less, which is practically effective, and the conveying belt can be cleaned, allowing smooth circulation of the conveying belt. Therefore, practically, the effects of the invention described in the above respective items can be exerted further effectively.

(5) In the inkjet recording apparatus of any one of items (1) to (4), the cleaning roller is arranged to be attachable to and detachable from the conveying belt.

According to item (5), during operation of an inkjet recording apparatus, a cleaning roller can be pressure-contacted with a conveying belt, and when the apparatus is not in operation, the cleaning-roller can be detached from the conveying belt. Thus, the cleaning roller does not remain in pressure-contact with the conveying belt all the time, and accordingly, permanent deformation and drop in the cleaning performance of the cleaning roller can be prevented. Therefore, in addition to the effects of the invention described in the above respective items, secure cleaning performance can be maintained for a long period.

A preferred embodiment of an inkjet recording apparatus in accordance with the invention will be described below referring to the drawings.

FIG. 1 is a schematic diagram showing an inkjet recording apparatus in accordance with the invention, wherein the inkjet recording apparatus 1 is a serial head type inkjet recording apparatus. The inkjet recording apparatus 1 is mainly constructed by an image recording section 2 for image recording on a recording medium P, and a conveying section 3 for conveying the recording medium P.

In the image recording section 2 of the inkjet recording apparatus 1, a bar-shaped carriage rail 4 is arranged horizontally. On the carriage rail 4, a carriage 5 driven by a carriage driving mechanism (not shown) is supported reciprocatively in a direction along the carriage rail 4 (hereinafter, referred to as the main scanning direction).

On the carriage 5, there are mounted recording heads 6 each having a plurality of nozzles for jetting ink onto the recording medium P under the carriage 5. The recording heads 6 are mounted in a quantity of 8 or 16 so that the carriage 5 can be used, for example, for an ink set of yellow (Y), magenta (M), cyan (C), and black (K), or a combination of this ink set and an ink set of light YMCK, etc. Further, on the carriage 5, there are mounted sub ink tanks, not shown, for storing inks in respective colors to be supplied to the recording heads 6. The respective sub ink tanks are connected with ink supply tubes connected to an ink tank that stores ink of the respective colors. Each sub ink tank is properly supplied with ink from a corresponding ink tank through an ink supply tube.

The recording heads 6, while scanning in the main scanning direction due to the reciprocal motion of the carriage 5 along the carriage rail 4, perform image recording by jetting ink in the respective colors from the nozzles. In the present embodiment, the recording heads 6 are set, herein, to jet the respective inks during scanning both in the forward direction and the backward direction to perform inkjet recording.

Below the image recording section 2 of the inkjet recording apparatus 1, there is provided a conveying section 3 including an endless conveying belt 7 for conveying the recording medium P in a direction (hereinafter, referred to as the sub scanning direction) orthogonal to the main scanning direction in a state that the recording medium P faces the nozzle surfaces of the recording heads 6.

For the conveying section 3, there are disposed a belt driving roller 8 for driving the conveying belt 7 in circulation, a driven roller 9, arranged approximately at the same horizontal level as the belt driving roller 8, for guiding the conveying belt 7 toward the belt driving roller 8, and a tension roller 10 below the belt driving roller 8 and the driven roller 9, the above rollers being disposed such that the respective axes are parallel to each other. The endless conveying belt 7 is wound around the belt driving roller 8, the driven roller 9, and the tension roller 10, wherein the conveying belt 7 is tensioned between the respective rollers by moving the tension roller 10, the tension roller 10 being movable outward and inward, outward with a moving device, not shown, and is supported by the respective rollers from the inner surface side. The conveying section 3 can adjust the tension applied to the conveying belt 7 by adjusting the outward-moving distance of the tension roller 10.

A motor 11 is connected to the belt driving roller 8 to drive and rotate the same, whereby the conveying belt 7 is circulated from the position of the belt driving roller 8, through the tension roller 10 and the driven roller 9, and toward the direction (hereinafter, referred to as the conveying direction) of the belt driving roller 8. Incidentally, between the driven roller 9 and the belt driving roller 8, both being arranged below the image recording section 2, the conveying direction of the conveying belt 7 and the sub scanning direction are the same.

Between the driven roller 9 and the belt driving roller 8, a belt guide plate 12 in a flat plate shape is arranged in such a manner that the belt guide plate 12 supports the conveying belt 7 from the inner surface side. Thus, the conveying belt 7 moves, accurately facing the nozzle surfaces of the recording heads 6 without deflecting downwards due to gravity.

The recording medium P of cloth or the like is fed on the outer surface of the endless conveying belt 7 at a position near the driven roller 9 or upstream from there in the conveying direction, then, an image is recorded by the recording heads 6 on the recording medium P, and the recording medium P is detached from the outer surface of the conveying belt 7 at the position of the belt driving roller 8 or on the downstream side from there in the conveying direction. The outer surface of the conveying belt 7 may be made adhesive to prevent the recording medium P from sliding on the conveying belt 7, an electrostatic power generator may be employed as the belt guide plate 12, or a separate electrostatic power generator may be arranged on the belt guide plate 12 to charge the conveying belt, thereby making the recording medium P adhere to or get sucked on the conveying belt 7, as necessary.

On the outer side of the tension roller 10, a cleaning device 13 for cleaning the conveying belt 7 is provided, and the cleaning device 13 has a cleaning roller 14 for cleaning the conveying belt 7, the rotation axis of the cleaning roller 14 being parallel to the rotation axis of the tension roller 10. To the cleaning roller 14, there is fitted a pressure-contacting and releasing mechanism 15 for pressure-contacting of the cleaning roller 14 with the conveying belt 7 which is supported by the tension roller 10 from the inner side, and releasing the pressure-contact.

Preferably, the cleaning roller 14 is made of polyvinyl chloride (PVC) or polyvinyl alcohol (PVA), which can be formed into a long roller so that the cleaning roller 14 can be applied even in the case where the belt width of the conveying belt 7 is as large as or larger than 1 meter. In the present embodiment, a polyvinyl chloride open-cell foam (hereinafter, referred to as a PVC open-cell foam) roller is employed as the cleaning roller 14. An open-cell foam, herein, is a kind of porous materials, wherein foams present inside the open-cell foam are connected with each other.

Figure 2:
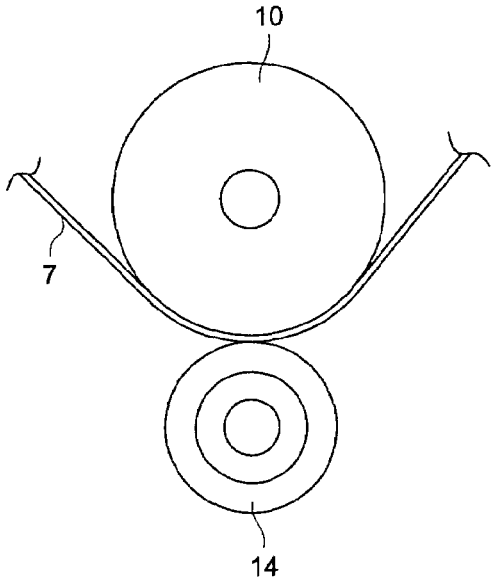
FIG. 2 is a schematic diagram showing a cleaning roller, a conveying belt, and, a tension roller of the inkjet recording apparatus, to illustrate the pressing depth of the cleaning roller against the conveying belt, wherein (A) shows a state where the cleaning roller is in contact with the conveying belt, and (B) shows a state where the cleaning roller is deformed due to pressure.
Figure 2:
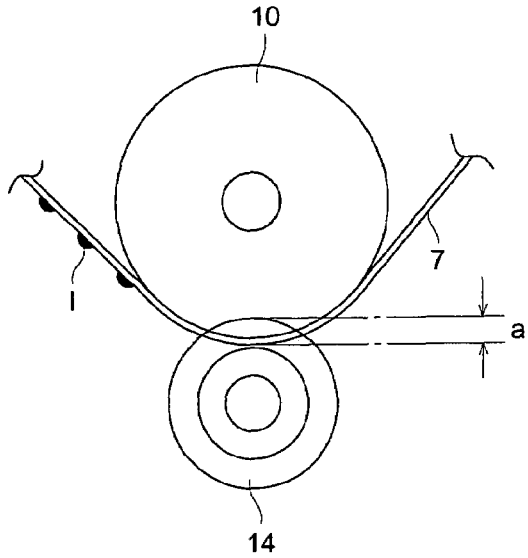

In the present embodiment, the cleaning roller 14 is set by the pressure-contacting and releasing mechanism 15 such that the pressing depth against the conveying belt 7 is in a range from 1 to 3 mm. The pressing depth of the cleaning roller 14 against the conveying belt 7 is, as shown in FIG. 2, a displacement a from the state (see (A) in FIG. 2) where the cleaning roller 14 is just in contact with the surface of the conveying belt 7 on the outer surface side of the conveying belt 7, the conveying belt 7 being supported by the tension roller 10 on the inner surface side, to a state (see (B) in FIG. 2) where the cleaning roller 14 is pressed to the side of the conveying belt 7 against it. FIG. 2 is a schematic diagram for illustrating the pressing depth. In (B) in FIG. 2, the state where the cleaning roller 14 is pressed and ink I is deposited on the conveying belt 7 is shown exaggerating a real state.

The cleaning roller 14 is connected with a cleaning roller driving motor 16 for driving rotation of the cleaning roller 14. The cleaning roller driving motor 16 is arranged to drive rotation of the cleaning roller 14 in the same direction as the conveyance direction of the conveying belt 7, that is, in such a manner that the direction of the surface linear speed of the cleaning roller 14 at the pressure-contact point between the cleaning roller 14 and the conveying belt 7 is the same as the conveyance direction of the conveying belt 7. Further, the cleaning roller driving motor 16 is arranged to rotate the cleaning roller 14 at a surface linear speed thereof lower than the conveyance speed of the conveying belt 7.

Under the cleaning roller 14, a water bath 18 storing water 17 being the cleaning liquid used with the cleaning roller 14 is disposed in such a manner that a portion of the cleaning roller 14 dips in the water 17. The water bath 18 is provided with water supply means 19 for supplying water such as a hose, for example, and a water drain outlet, not shown.

Next, operation of the inkjet recording apparatus of the invention will be described.

In the image recording section 2 (see FIG. 1) of the inkjet recording apparatus 1, the carriage 5 reciprocally moves in the main scanning direction along the carriage rail 4. With the reciprocal motion of the carriage 5, while scanning the upper side of the recording medium P in the main scanning direction, the recording heads 6 mounted on the carriage 5 perform image recording, by jetting inks in the respective colors from the nozzles onto the recording medium P.

In the present embodiment, as mentioned above, the recording heads 6 are arranged to perform inkjet recording in both the forward scanning and the backward scanning. Specifically, in a state that the conveying belt 7 is not moving and accordingly the recording medium P is stopped, the recording heads 6 jet ink onto the recording medium P to perform image recording in a width of the recording heads while scanning in the forward direction of the main scanning direction. When the scanning of the recording heads 6 in the forward direction is completed, the conveying belt 7 moves, conveys the recording medium P for the width of the recording heads in the sub scanning direction, and stops the recording medium P. Then, the recording heads 6 likewise performs image recording in the width of the recording heads by jetting ink in the backward direction, scanning backward. When the scanning of the recording heads 6 in the backward direction is completed, the conveying belt 7 again moves to convey the recording medium P in the sub scanning direction for the width of the recording heads and stops the recording medium P. An image is recorded on the surface of the recording medium P by repeating this process.

In order that the recording medium P repeats moving and stopping with accuracy in synchronization with inkjet recording by the image recording section 2, conveyance accuracy of the conveying belt 7 is adjusted in the conveying section 3 of the inkjet recording apparatus 1. Concretely, the rotation amount and the rotation timing of the intermitted driving of the belt driving roller 8 by the motor 11 are fine adjusted so that the conveying belt 7 is circulated and stopped with accuracy. Further, the tension roller 10 is moved outward and inward to adjust the tension applied to the conveying belt 7 in relation to its circulation.

The cleaning roller 14 of the cleaning device 13 is pressure-contacted, as mentioned above, by the pressure-contacting and releasing mechanism 15, with the conveying belt 7 supported by the tension roller 10 at the inner surface side such that the pressing depth of the cleaning roller 14 is in the range from 1 to 3 mm. In the present embodiment, the cleaning roller 14 is, as mentioned above, constructed as a PVC open-cell foam roller and is softer (hardness is 10 measured by a measuring instrument according to JIS K 6253) than the tension roller 10 of steel, and accordingly, the pressure-contact portion of the cleaning roller 14 gets depressed, as shown in (B) in FIG. 2, into a shape along the curved surface of the conveying belt 7.

Further, as described above, the conveying belt 7 intermittently circulates, driven by the belt driving roller 8.

During circulation of the conveying belt 7, the cleaning roller 14 is driven to rotate by the cleaning roller driving motor 16 in the same direction as the conveyance direction of the conveying belt 7 in such a manner that the surface linear speed of the cleaning roller 14 is lower than the conveyance speed of the conveying belt 7.

In this situation, when a portion of the cleaning roller 14 having absorbed the water 17 in the water bath 18 under the cleaning roller 14 has rotated to the pressure-contact position with the conveying belt 7, the absorbed water 17 is squeezed out on the surface of the cleaning roller 14 by a pressure from the conveying belt 7 supported by the tension roller 10 from the inner surface side, and the water comes out on the surface of the cleaning roller 14. Then, the water having come out on the surface of the cleaning roller 14 dissolves and diffuses the ink I deposited on the surface of the conveying belt 7 into the water (see (B) in FIG. 2). The above mentioned portion of the cleaning roller 14 has little water inside it because the water has been squeezed out at the position of pressure-contact with the tension roller 10, and therefore, after passing the pressure-contact position, the portion of the cleaning roller 14 tends to absorb the water with the dissolved ink into inside the cleaning roller 14.

Further, since the surface linear speed of the cleaning roller 14 is set, as described above, to be lower than the conveyance speed of the conveying belt 7, the cleaning roller 14 have functions, not only to absorb, but also to wipe off the ink on the conveying belt 7. In this way, ink remaining and deposited on the conveying belt 7 is removed from the conveying belt 7. The water having dissolved and diffused ink in it is also absorbed by the cleaning roller 14 to be removed from the conveying belt 7.

The water 17 containing the ink and absorbed by the cleaning roller 14 is replaced by fresh water 17 in the water bath 18 under the cleaning roller 14. For example, it is also possible to provide a mechanism, in the water bath 18, for squeezing out the ink containing water 17 from the cleaning roller 14 and promoting replacement with fresh water 17. Further, as described above, since the water bath 18 of the cleaning device 13 is provided with a water supply means 19 for supplying water to be the cleaning liquid, water 17 in the water bath 18 stained with ink and the like can be replaced with fresh water, as necessary.

Incidentally, making a difference from the above case, if the cleaning roller 14 is driven to rotate in the direction opposite to the conveyance direction of the conveying belt 7, phenomenon opposite to the above occurs, that is, just after a portion of the conveying belt 7 has passed the pressure-contact position, the portion of the conveying belt 7 comes in contact with a portion of the cleaning roller on which surface water has come out. Therefore, the portion of the conveying belt 7 gets wet a lot after having passed the pressure-contact position with the cleaning roller 14, which requires drying of the conveying belt 7 after cleaning, for practical use, as necessary in the conventional cases.

As described above, regarding the cleaning device 13 of the inkjet recording apparatus 1 of the invention, the cleaning roller 14 is pressure-contacted with the conveying belt 7 from the outer surface side of the conveying belt 7, the conveying belt 7 being supported on the inner surface side by the tension roller 10, and the cleaning roller 14 can be rotated in the same direction as the conveyance direction of the conveying belt 7, further, at the surface linear speed of the cleaning roller 14 lower than the conveyance speed of the conveying belt 7. Therefore, ink I deposited on the conveying belt 7 can be dissolved and diffused into water 17 squeezed out form the cleaning roller 14 and wiped off, and then the water 17 containing the ink I is absorbed by the cleaning roller 14, which makes it possible to securely remove ink on the conveying belt 7.

Further, in the inkjet recording apparatus 1 of the invention, the water 17 having dissolved and diffused the ink I therein can be effectively absorbed by the cleaning roller 14, making it possible to reduce the wetness of the conveying belt 7 to an extremely low level after the portion, which is discussed here, of the conveying belt 7 has passed the cleaning device 13. Therefore, during when the portion of the conveying belt 7 moves from the position of the tension roller 10 to the position of the driven roller 9 and the recording medium P is fed on the conveying belt 7 at a position near the driven roller 9, the above portion of the conveying belt 7 is almost completely dried. Accordingly, the inkjet recording apparatus 1 of the invention does not require a conventional drying device or the like, reducing electrical power consumption.

Still further, as in the present embodiment, by pressure-contacting the cleaning roller 14, parallelly to the tension roller 10, with the conveying belt 7 supported by the tension roller 10 on the inner surface side, the cleaning roller 14 can be pressure-contacted with the conveying belt 7 uniformly over the entire width of the conveying belt 7 even if the conveying belt 7 has an extremely large lateral length like a conveying belt used for textile printing on cloth, thereby allowing it to effectively remove ink from the entire conveying belt 7.

Yet further, by the use of a PVC open-cell foam as the material of the cleaning roller 14, a long roller can be formed, as mentioned above. Also, as ink is dissolved into water 17 in the water bath 18 without remaining on the surface of the PVC open-cell foam roller or inside it, making a difference from a conventional case, the cleaning roller 14 can maintain a high ink absorption capability for a relatively long period. Accordingly, secure cleaning performance as mentioned above can be maintained for a long time. As stated above, by providing a squeezing mechanism in the water bath 18 of the cleaning device 13, dissolution of ink in the cleaning roller 14 into the water 17 can be promoted.

Next, based on experiments, effects by the driven rotation of the cleaning roller 14 on the conveyance accuracy of the conveying belt 7 will be discussed. Through this discussion, it will also be discussed about the appropriateness of the following points, namely, setting the load to be applied to the cleaning roller 14 in rotating the cleaning roller 14 such that the pressing depth of the cleaning roller 14 against the conveying belt 7 which is, supported by the tension roller 10 at the inner surface side is to be in a range from 1 to 3 mm, and setting the surface linear speed of the cleaning roller 14 to be lower than the conveyance speed of the conveying belt 7. Incidentally, the cleaning roller 14 is constructed, as described above, as a PVC open-cell foam roller having hardness of 10 measured by a measuring instrument according to JIS K 6253.

Figure 3:
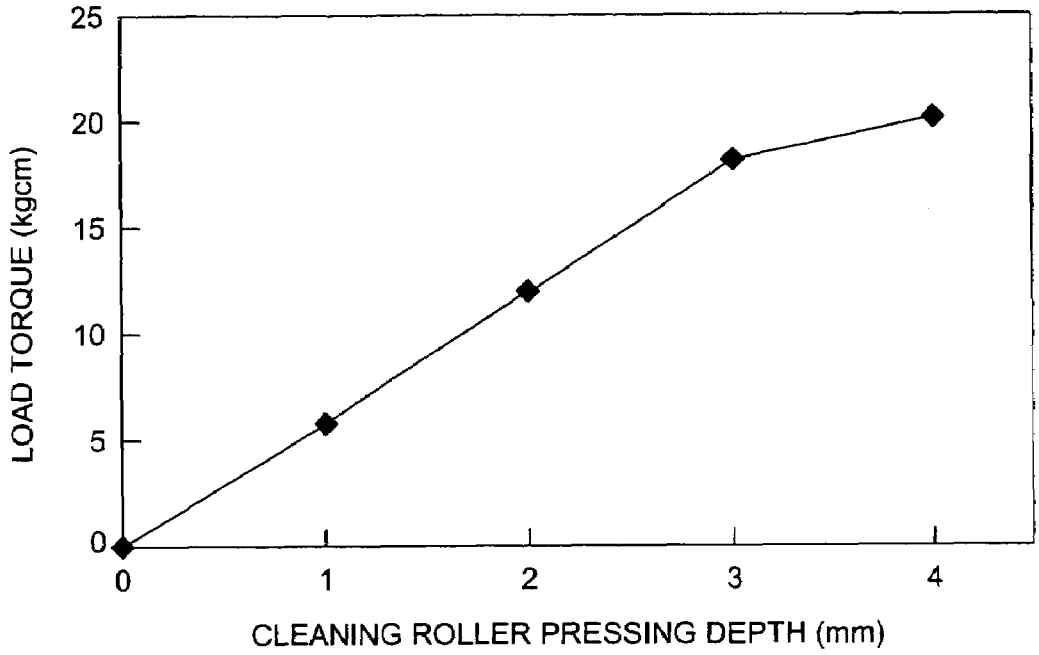
FIG. 3 is a graph showing the relationship between the pressing depth of the cleaning roller and a load torque applied to a belt driving roller.
Figure 4:
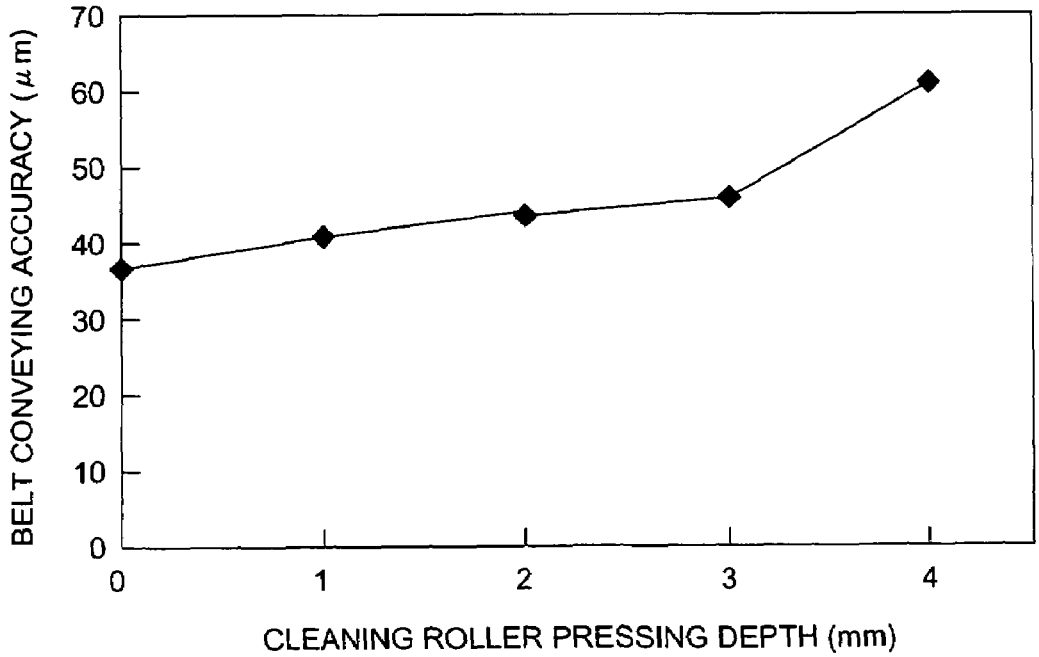
FIG. 4 is a graph showing the relationship between the pressing depth of the cleaning roller and the conveyance accuracy of the conveying belt.

FIG. 3 is a graph showing the relationship between the pressing depth of the cleaning roller and the load torque applied to the belt driving roller. FIG. 4 is a graph showing the relationship between the pressing depth of the cleaning roller and the conveyance accuracy of the conveying belt. The load torque applied to the belt driving roller 8 was obtained by measuring the load torque applied to the motor 11 that drives the belt driving roller 8. The conveyance accuracy of the conveying belt 7 was determined by printing one line of a dot row each time of scanning of the recording heads 6, on a recording sheet by the inkjet recording apparatus 1; repeating scanning a plurality of times; then, measuring the distance between dot rows; and obtaining the difference between the maximum value and the minimum value. The cleaning roller 14 was driven to rotate in the same direction as the conveyance direction of the conveying belt 7 such that the surface linear speed of the cleaning roller 14 is half of the conveyance speed of the conveying belt 7.

First, regarding the relationship between the pressing depth of the cleaning roller 14 and the load torque applied to the belt driving roller 8 (see FIG. 3), it is understood that when the pressing depth of the cleaning roller 14 is increased by applying a load, the load torque applied to the belt driving roller 8 increases. When the pressing depth becomes 4 mm or larger, increase in the load torque applied to the belt drive roller 8 starts saturating. As a phenomenon, when the load becomes too large, the rotation speed of the cleaning roller 14 can hardly be kept constant, and the cleaning roller 14 rotates driven by the motion of the conveying belt 7, that is, the surface linear speed of the cleaning roller 14 cannot be maintained to be half of the conveyance speed of the conveying belt 7, which is observed as a phenomenon of increase in the rotation speed of the cleaning roller 14. In other words, a load with a pressing depth of 4 mm or larger makes the cleaning roller 14 rotate driven by the conveyance of the conveying belt 7, and therefore, it is understood that increase in the load torque applied to the belt driving roller 8 saturates. If the cleaning roller 14 rotates driven by the conveyance of the conveying belt 7, as describe above, the above mentioned effects of the invention cannot be attained.

Next, the relationship between the pressing depth of the cleaning roller and the conveyance accuracy of the conveying belt 7 (see FIG. 4) will be discussed. In increasing the pressing depth of the cleaning roller 14, if the pressing depth is 3 mm or smaller, the conveyance accuracy is almost the same as that (approximately 40 μm) in a case of a pressing depth of 0 mm, namely, a case where the cleaning roller 14 is not pressed. If the pressing depth is 4 mm or larger, the conveyance accuracy degrades (approximately 60 μm). It is understood that this is because if the cleaning roller 14 is pressure-contacted with the conveying belt 7 with a load that makes the pressing depth 4 mm or larger, smooth circulation of the conveying belt 7 is inhibited by the friction caused by the cleaning roller 14 rotating at a surface linear speed different from the conveyance speed of the conveying belt 7, and thus the conveyance accuracy becomes unstable.

From the above mentioned results of FIGS. 3 and 4, it is understood that the load to be applied to the cleaning roller 14 is preferably a load that makes the pressing depth of the cleaning roller 14 against the conveying belt 7 in a range 3 mm or smaller.

In FIG. 3, a graph is shown in which it appears that the load torque increases in proportion to the pressing depth of the cleaning roller 14 if the pressing depth is in a range of from 0 to 3 mm. However, actually, flexibility of the cleaning roller 14 sometimes shows a solid state that refuses further pressing after being pressed to a certain extent, and it is not understood that the flexibility is constant. Specifically, if the cleaning roller 14 is pressed against the conveying belt 7, not only the pressure against the conveying belt 7, but also the degree of the flexibility of the cleaning roller 14 and the coefficient of dynamic friction between the cleaning roller 14 and the conveying belt 7, are thought to change. Therefore, the load torque does not necessarily increase in proportion to the pressing depth of the cleaning roller 14.

Figure 5:
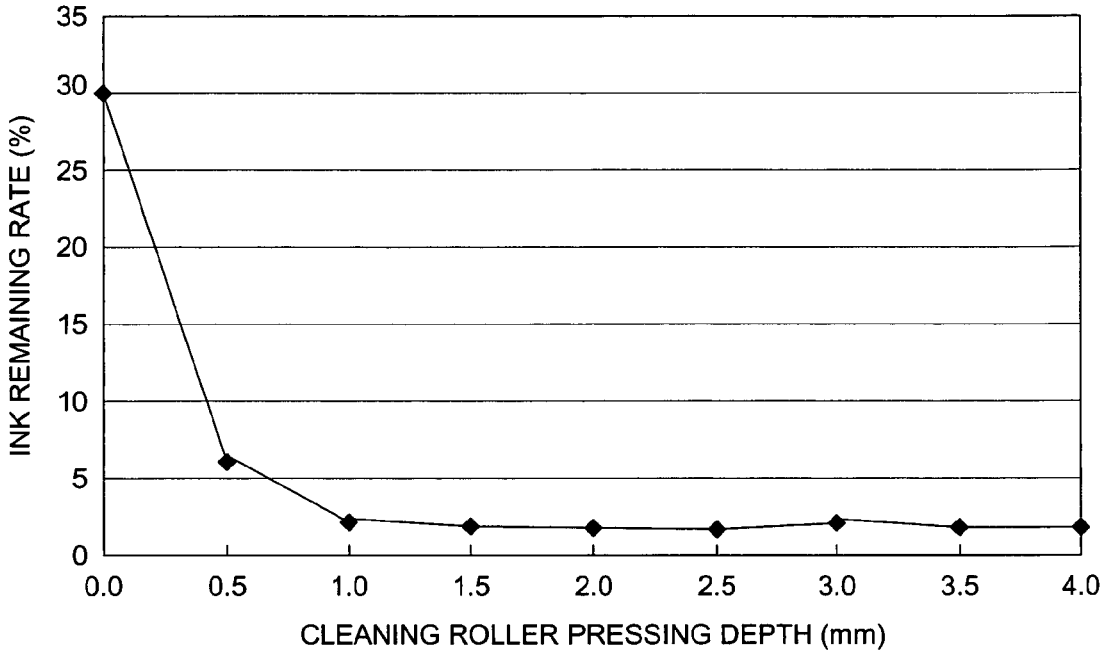
FIG. 5 is a graph showing the relationship between the pressing depth of the cleaning roller and the ink remaining rate on the conveying belt after cleaning.

Next, FIG. 5 is a graph which shows the ink remaining rate on the conveying belt after cleaning, in the case of varying the pressing depth of the cleaning roller. The ink remaining rate was obtained by coating a certain amount of ink on the conveying belt 7 on the upstream side of the conveying belt 7, with respect to the cleaning roller 14 and in the conveyance direction; measuring the ink amount remaining on the conveying belt 7 after the portion of the conveying belt 7 has passed the cleaning roller 14; and calculating the rate. The ink removal efficiency can be obtained as 100%—(ink remaining rate). The cleaning roller 14 was driven to rotate in the same direction as the conveyance direction of the conveying belt 7, setting the surface linear speed of the cleaning roller 14 to be half of the conveyance speed of the conveying belt 7.

As shown in FIG. 5, when the pressing depth of the cleaning roller 14 is 0 mm, that is, the cleaning roller 14 is just in contact with the conveying belt 7, the ink remaining rate is high. As the cleaning roller 14 is pressed more, the ink remaining rate drops, and when the pressing depth is 1.0 mm or larger, the ink remaining rate is almost constant, thus the ink removal efficiency saturating. Experiments by the inventor and others proved that an ink remaining rate of 5% or lower is practically enough. According to the experiments, it is understood that a load to be applied to the cleaning roller 14 which makes the pressing depth of the cleaning roller 14 in a range 1.0 mm or larger is large enough.

Summing up the results of FIGS. 3 to 5, the load to be applied to the cleaning roller 14 is to be set such that the pressing depth of the cleaning roller 14 against the conveying belt 7 is in a range from 1 to 3 mm.

Figure 6:
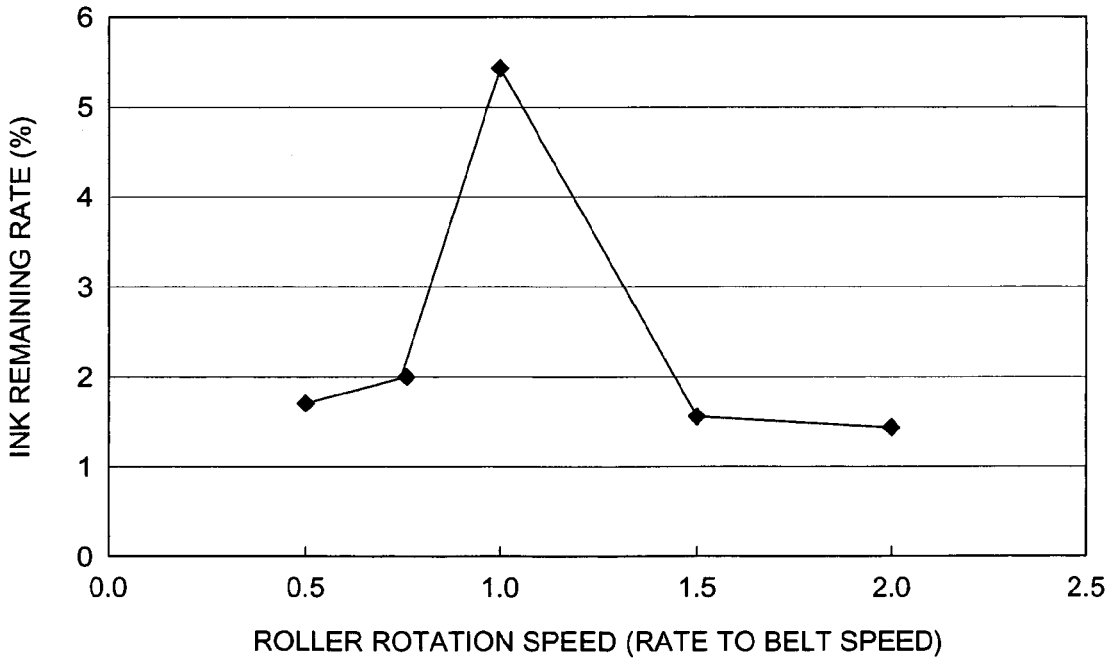
FIG. 6 is a graph showing the relationship between the rotation speed of the cleaning roller and the ink remaining rate on the conveying belt after cleaning.
Figure 7:
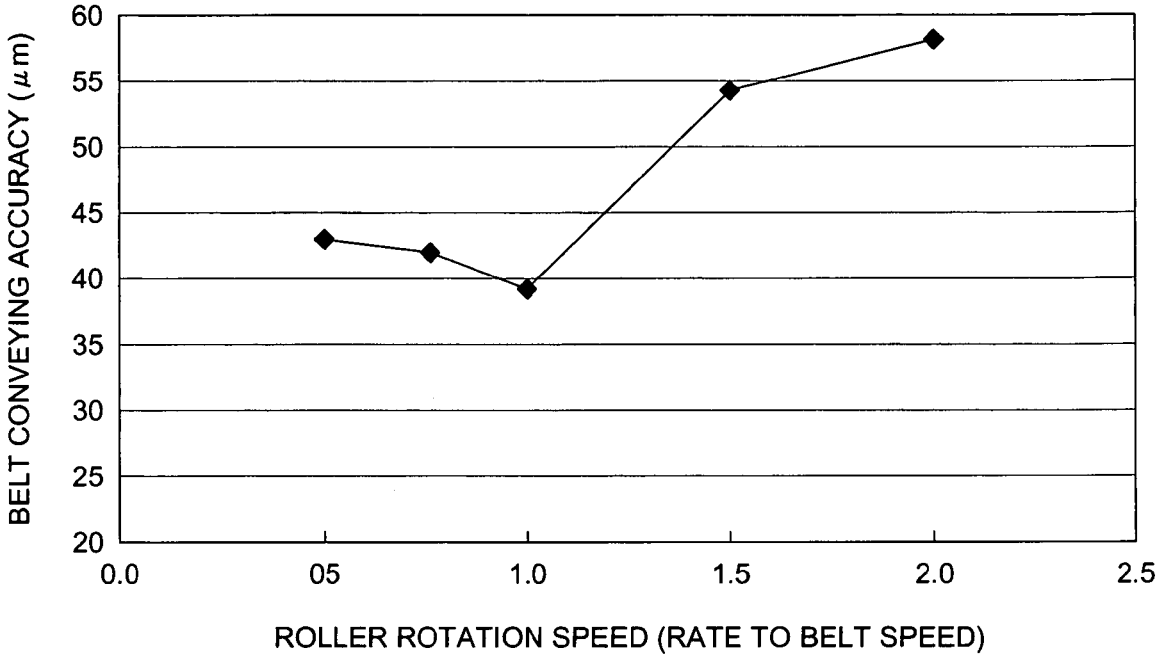
FIG. 7 is a graph showing the relationship between the rotation speed of the cleaning roller and the conveyance accuracy of the conveying belt.

Next, it will be discussed about the appropriateness of rotating the cleaning roller 14, setting the surface linear speed of the cleaning roller 14 to be lower than the conveyance speed of the conveying belt 7. FIG. 6 is a graph showing the ink remaining rate on the conveying belt after cleaning with variation of the rotation speed of the cleaning roller. FIG. 7 is a graph showing the relationship between the rotation speed of the cleaning roller and the conveyance accuracy of the conveying belt. The conveyance accuracy of the conveying belt 7 and the ink remaining rate were measured by the same methods as described above. The load to be applied to the cleaning roller 14 was set such that the pressing depth against the conveying belt 7 is 2 mm.

From the results shown by FIG. 6, it is understood that the ink remaining rate in the case of rotating the cleaning roller 14 at its surface linear speed (ratio to belt speed is 0.5) lower than the conveyance speed of the conveying belt 7, and the ink remaining rate in the case of rotating the cleaning roller 14 at its surface linear speed (ratio to belt speed is 2.0) higher than the conveyance speed of the conveying belt 7, are almost the same level.

However, as sown in FIG. 7, regarding effects on the conveyance accuracy of the conveying belt 7, it is understood that the conveyance accuracy degrades little in the former case, and practically, the effects can be reduced to an almost negligible extent, while far worse effects are given in the latter case. From these results, it is understood that the rotation speed of the cleaning roller 14 is to be set as in the former case, that is, the cleaning roller 14 is rotated at its surface linear speed lower than the conveyance speed of the conveying belt 7.

The results of FIG. 7 can be explained as follows. As described before, the conveying belt 7 is inherently given proper tension by the tension roller 10 and the like. If the surface linear speed of the cleaning roller 14 is set to be lower than the conveyance speed of the conveying belt 7 (for example, ratio to belt speed is 0.5), additional tension is applied to the conveying belt 7, by friction due to the rotation of the cleaning roller 14, in the direction opposite to the conveyance direction, which increases the tension applied to the conveying belt 7 at a part just under the recording heads 6 of the inkjet recording apparatus 1. Such an increase in tension tends to further increase the tightness of the contact of the conveying belt 7 with the belt driving roller 8 and the driven roller 9, and accordingly degrades the conveyance accuracy little, or degrades it, if any, with extremely small effects (in FIG. 7, the degree of degradation is approximately 4 μm compared with the case where ratio to belt speed is 1.0). On the other hand, if the surface linear speed of the cleaning roller 14 is set to be higher than the conveyance speed of the conveying belt 7 (for example, ratio to belt speed is 2.0), a friction force due to the rotation of the cleaning roller 14 is applied to the conveying belt 7 in the same direction as the conveyance direction, which decreases the tension applied to the conveying belt 7 at a part just under the recording heads 6 of the inkjet recording apparatus 1. It is understood that if tension applied to the conveying belt 7 is decreased thus, the tightness of the contact of the conveying belt 7 with the belt driving roller 8 and the driven roller 9 is decreased, which degrades the stability of the convey of the conveying belt 7 and drops the conveyance accuracy (in FIG. 7, the degree of degradation is approximately 20 μm compared with the case where ratio to belt speed is 1.0).

In FIG. 6, the ink remaining rate is degraded when the cleaning roller 14 is rotated at the same speed (ratio to belt speed is 1.0) as the conveyance speed of the conveying belt 7. However, in this case, it is understood that this degradation occurs because the cleaning roller 14 only absorbs ink on the conveying belt 7 and water containing the ink, and cannot wipe off them from the conveying belt 7.

In the present embodiment., it has been described about a case where the inkjet recording apparatus 1 is a serial head type. However, the invention can also be applied, for example, to an inkjet recording apparatus of a line head type and the like.

Further, although in the present embodiment, it has been described about the case where the cleaning roller 14 is pressure-contacted with the conveying belt 7 which is supported by the tension roller 10 from the inner surface side, a support member for supporting the conveying belt 7 from the inner surface side may be a roller other than the tension roller 10, and it is also possible to provide another roller for pressure-contacting of the cleaning roller 14.

Figure 8:
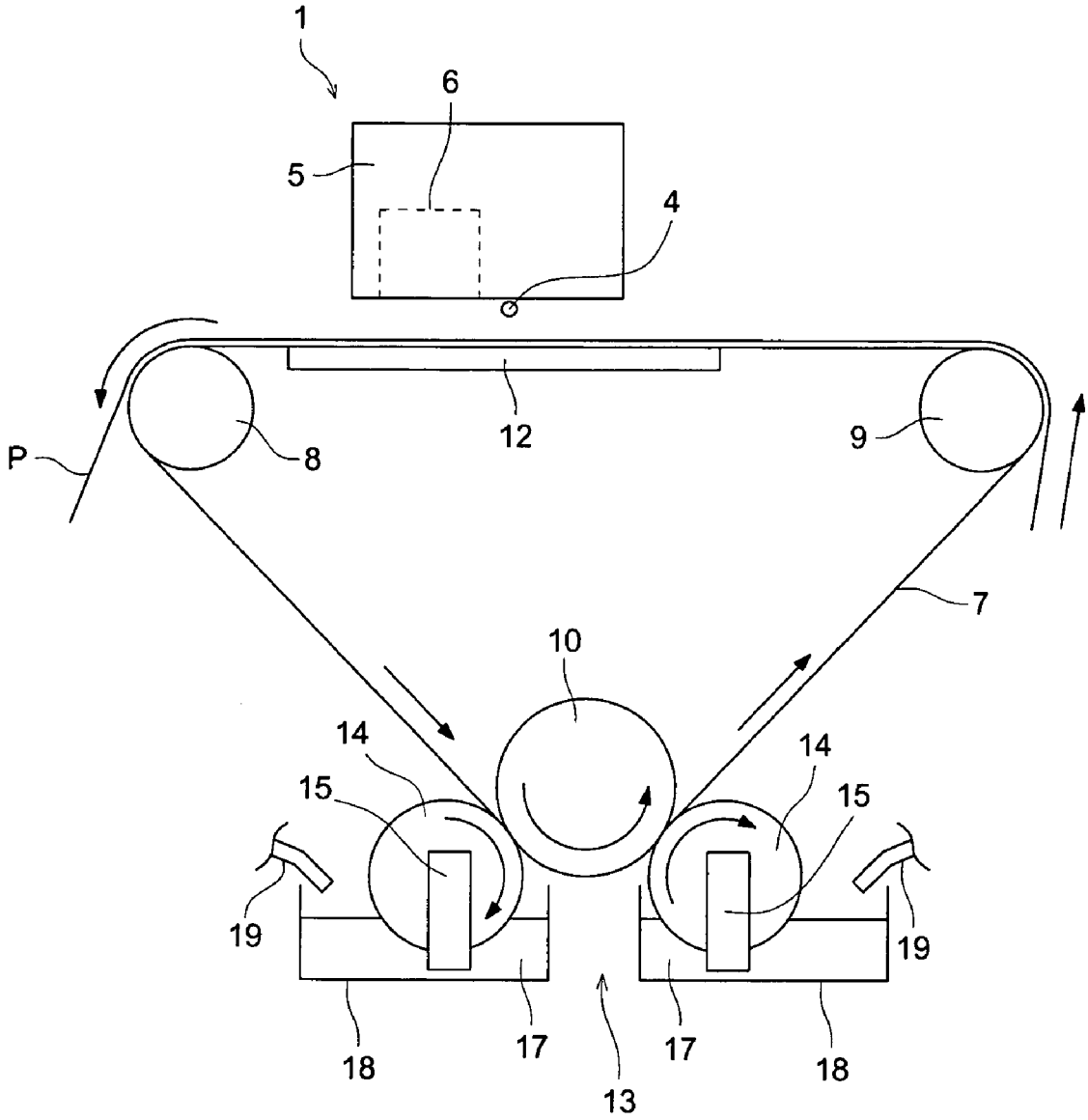
FIG. 8 is a schematic diagram showing another embodiment in which cleaning devices are arranged in two respective places to clean a conveying belt.

Still further, although in the present embodiment, it has been described about the case where the cleaning device 13 is provided for the conveying belt 7 at a single position, it is also possible to apply the invention exactly in the same manner even in a case where cleaning devices 13 are provided at more than one positions for respective cleaning rollers, as shown in FIG. 8.

What is claimed is:

1. An inkjet recording apparatus for forming an image on a recording medium, comprising:

a conveying belt for supporting and conveying a recording medium in a conveying direction;

a recording head for forming an image by jetting ink onto the recording medium conveyed by the conveying belt; and a cleaning device including a cleaning roller which is provided in pressure-contact with the conveying belt and which is drivable to rotate in a same direction as the conveying direction;

wherein the cleaning roller is set to rotate such that a surface linear speed thereof is lower than a conveying speed of the conveying belt, and the cleaning roller cleans the conveying belt while the recording head forms the image.

2. The inkjet recording apparatus of claim 1, wherein a pressing depth of the cleaning roller against the conveying belt is set to be within a range such that a percentage of ink remaining on the conveying belt after cleaning is not more than 5% and the cleaning roller is not caused to rotate by friction between the cleaning roller and the conveying belt.

3. The inkjet recording apparatus of claim 1, wherein the cleaning roller comprises a PVC open-cell foam roller.

4. The inkjet recording apparatus of claim 1, wherein the cleaning roller is pressure contacted with the conveying belt by a load that makes a pressing depth of the cleaning roller against the conveying belt within a range from 1 to 3 mm.

5. The inkjet recording apparatus of claim 1, wherein the cleaning roller is movable into and out of the pressure-contact with the conveying belt.

6. The inkjet recording apparatus of claim 1, wherein the cleaning device comprises a cleaning liquid tank, and the cleaning roller cleans the conveying belt with the cleaning liquid in the cleaning liquid tank.

7. An inkjet recording apparatus for forming an image on a recording medium, comprising:

a conveying belt for supporting and conveying a recording medium in a conveying direction;

a recording head for forming an image by jetting ink onto the recording medium conveyed by the conveying belt; and a cleaning device including a cleaning roller which is provided in pressure-contact with the conveying belt and is drivable to rotate in a same direction as the conveying direction;

wherein the cleaning roller is set to rotate such that a surface linear speed thereof is lower than a conveying speed of the conveying belt; and wherein the cleaning roller is attachable to and detachable from the conveying belt.

* * * * *